US005865647A

United States Patent [19]

Garber et al.

[11] Patent Number: 5,865,647

[45] Date of Patent: Feb. 2, 1999

[54] LANDSCAPE LIGHTING SOCKET

[75] Inventors: Thomas A. Garber, Hudson; George J. Uhler, Wadsworth, both of Ohio

[73] Assignee: The L.D. Kichler Co., Cleveland, Ohio

[21] Appl. No.: 700,220

[22] Filed: Aug. 20, 1996

[51] Int. Cl.[6] ..... H01R 17/00

[52] U.S. Cl. ..... 439/611; 439/699.2

[58] Field of Search ..... 439/356, 611, 439/619, 699.2; 313/318.01, 318.12

[56] References Cited

U.S. PATENT DOCUMENTS

| | | | |
|---|---|---|---|
| 4,804,343 | 2/1989 | Reedy | 439/699.2 X |
| 4,883,434 | 11/1989 | Toyoshima | 439/699.2 X |
| 5,580,159 | 12/1996 | Liu | 439/356 X |
| 5,630,729 | 5/1997 | Francis | 439/699.2 |
| 5,634,823 | 6/1997 | Furuta et al. | 439/619 X |

OTHER PUBLICATIONS

Temporary catalog of Christiana Industries Corporation dated 1991. No new catalog has been completed.

*Primary Examiner*—Khiem Nguyen
*Attorney, Agent, or Firm*—Watts, Hoffmann, Fisher & Heinke, Co., L.P.A.

[57] ABSTRACT

An electrical socket for a landscape lighting fixture includes a body having two side walls and two end walls extending between the side walls. The side and end walls cooperate to form a hollow interior for receiving a lamp. Each of the end walls is outwardly movable to permit one or more protrusions on the lamp to be received by the socket and includes one or more abutment surfaces each adapted to be engaged one of the protrusions to resist removal of the lamp from the socket.

19 Claims, 3 Drawing Sheets

17
26
10
18
30
20
16
76
24
28
22
50
74
16
52

16

74
66
64
74
75
60
68
74
56
70
75
62
66
70
62
54
52
58
78

LANDSCAPE LIGHTING SOCKET

FIELD OF THE INVENTION

The present invention relates to electrical bulb and socket assemblies, and in particular, to sockets for landscape lighting fixtures.

BACKGROUND OF THE INVENTION

As shown in FIG. 1A, an electrical bulb and socket assembly includes a lamp 10 and a socket 12 with a hollow interior 14 for receiving the lamp 10. The lamp 10 includes a rectangular base 16 that carries a bulb 17. The base 16 has two sides 18 and two ends 20. A plug portion 22 extends from the base 16 and has electrical contacts 24 that extend into the interior of the bulb to a filament 26. Protrusions 28 extend outwardly from the ends 20 of the base. The base may include grooves 30 extending along the sides 18.

The socket 12 includes two pieces 32, 34 that are aligned with each other, two side walls 36 and two end walls 38. The side walls 36 have fingers 40 for engaging one of the grooves 30 of the lamp base. The lamp 10 is fastened to the socket 12 by inserting the lamp base 16 into the socket interior 14. As the lamp is inserted into the socket, the side surfaces 18 of its base 16 move the side walls 36 of the socket 12 outwardly until the fingers 40 snap into the grooves 30.

FIG. 1B shows another form of socket and bulb assembly, which is from a motor vehicle. A socket 42 that receives the lamp 10 includes side walls 44 with fingers 46 which snap into the groove 30 of the lamp base.

Double filament bulbs (not shown) may be used rather than single filament bulbs such as when bulbs with a blinking feature are desired. The protrusions of double filament bulbs have a narrower width than the protrusions of single filament bulbs. Therefore, in many cases single filament bulbs cannot normally be inserted into sockets intended to receive double filament bulbs. Different protrusion widths are used in some applications to ensure the use of bulbs having a particular number of filaments to avoid exceeding the intended wattage of the bulb.

In landscape lighting, it is desirable to design the bulb and socket assemblies to be small and reliable. The socket of FIG. 1A is undesirable because it is made of two pieces 32, 34. As a result of this two-piece construction, the socket body halves may be misaligned during fabrication of the socket, which may result in poor electrical contact during use. The socket construction of FIG. 1B is undesirable since the side fingers 46 make it difficult to form the socket small enough for landscape lighting. Moreover, since the fingers 40, 46 of both sockets 12, 42 have a relatively complex shape, the sockets are undesirable in view of excessive tooling costs required for their manufacture.

SUMMARY OF THE INVENTION

The present invention is directed to a landscape socket and bulb assembly that is both economical to manufacture and reliable. The socket of the present invention advantageously has a one-piece construction, which overcomes the misalignment problems of the prior art. In addition, the socket does not require fingers of complex construction and thus, is more economical to fabricate than prior art sockets.

In its broad aspects, the present invention is directed to an electrical socket for landscape lighting that comprises a body having two side walls and two end walls extending between the side walls. The side walls and end walls cooperate to form a hollow interior for receiving a lamp. Each of the end walls is outwardly movable and includes an abutment surface that is adapted to be engaged by a protrusion on the lamp to resist removal of the lamp from the socket.

In one embodiment, each of the end walls includes a movable ear having an opening formed through the ear for receiving one of the protrusions. Each of the openings preferably has a generally rectangular shape. The body is preferably integrally formed as one piece and comprised of elastomeric material. Each side wall includes one or more slitted openings which separate the ears from the rest of the body and enable the ears to be deflected by the protrusions. An electrical contact assembly is mounted in the interior of the socket. Each of the end walls preferably includes a groove on an interior surface for receiving a protrusion.

In a preferred embodiment, the electrical socket of the present invention includes a body having the movable ears. Each of the ears has the opening formed through it defined by edges of the end wall. One of these edges forms the abutment surface that is adapted to be engaged by one of the protrusions on the lamp to resist removal of the lamp from the socket.

The socket of the present invention overcomes the problems of prior art sockets. Since the socket of the present invention does not include the prior art fingers, it can be designed to have a small size. In addition, the socket of the invention is preferably integrally formed as one piece and thus, does not suffer from the misalignment problems of two-piece sockets. The lamp is securely fastened to the socket by engaging the protrusions with the abutment surfaces. The present socket design permits the lamp to be conveniently removed from the socket by deflecting the ears outwardly when they are contacted by the protrusions.

A method of using the socket of the present invention in a landscape lighting fixture includes the step of inserting a portion of the lamp into the hollow interior of the electrical socket. The protrusions on the end portions of the lamp engage the end walls of the socket, which deflects the end walls outwardly. Withdrawal of the lamp from the socket is prevented by positioning the protrusions to contact an abutment surface of one of the end walls.

The lamp is unfastened from the socket by engaging each of the protrusions with one of the abutment surfaces and exerting a pulling force on the lamp to deflect the ears outwardly by contacting each of the protrusions with the end walls. One aspect of the method includes moving each of the protrusions into and from one of the openings. The end walls are deflected toward and away from the slitted openings.

Other embodiments of the invention are contemplated to provide particular features and structural variants of the basic elements. The specific embodiments referred to as well as possible variations and the various features and advantages of the invention will become better understood from the accompanying drawings and the detailed description that follows.

DETAILED DESCRIPTION OF PREFERRED EMBODIMENTS

Figure 1A:
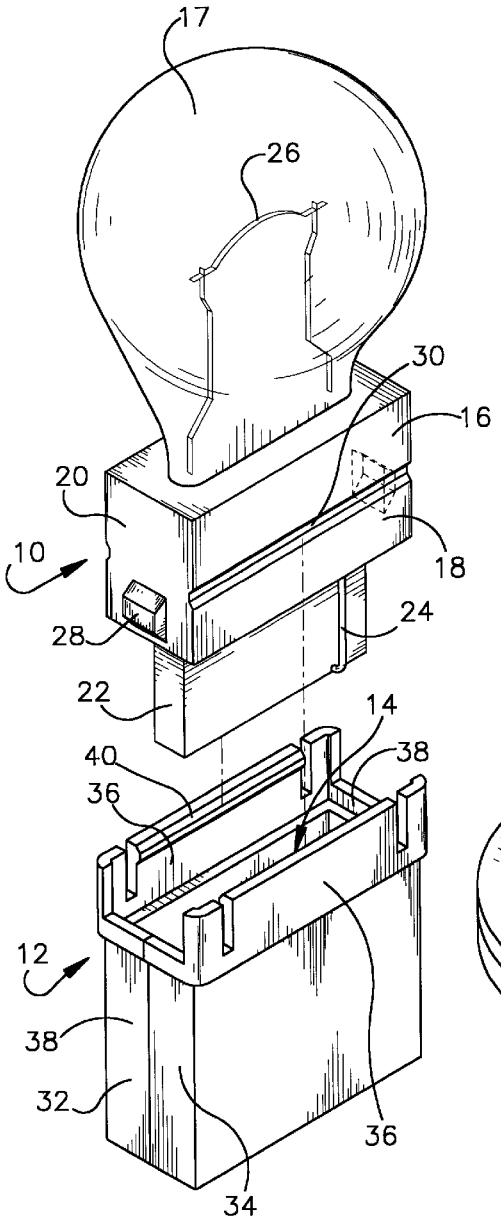
Fig.1A (PRIOR ART)
FIGS. 1A and 1B are perspective views of prior art bulb and socket assemblies.
Figure 1B:
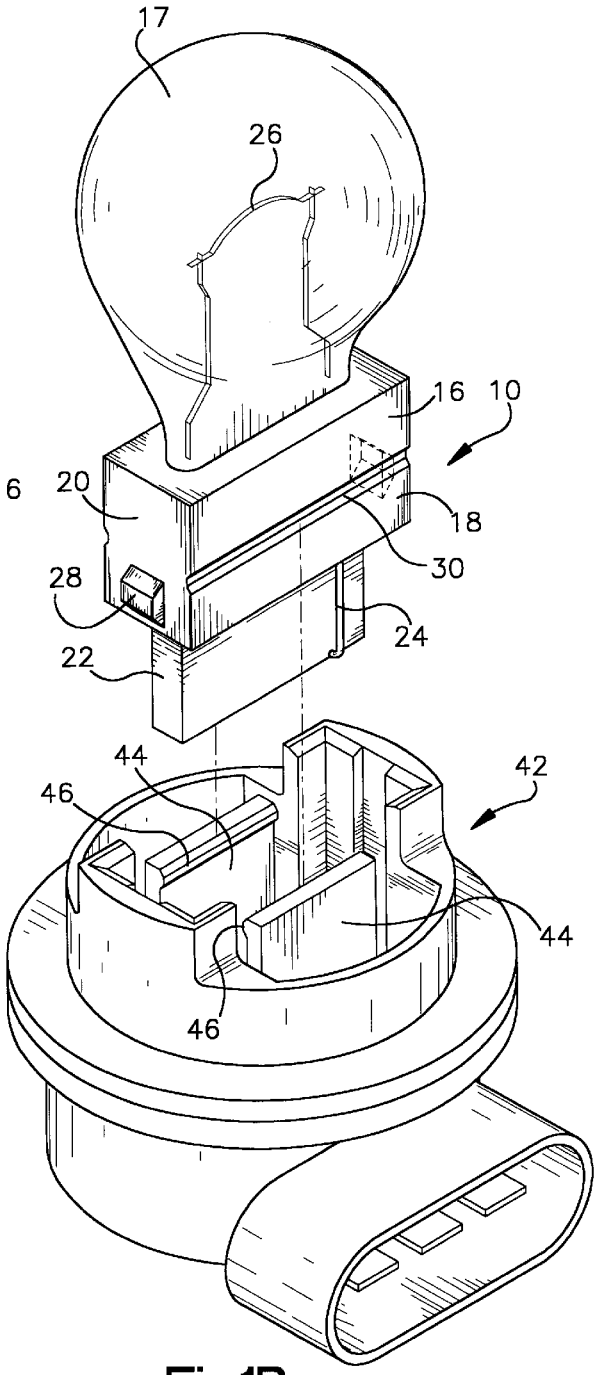
Fig.1B (PRIOR ART)
Figures 2, 5A, 5B:
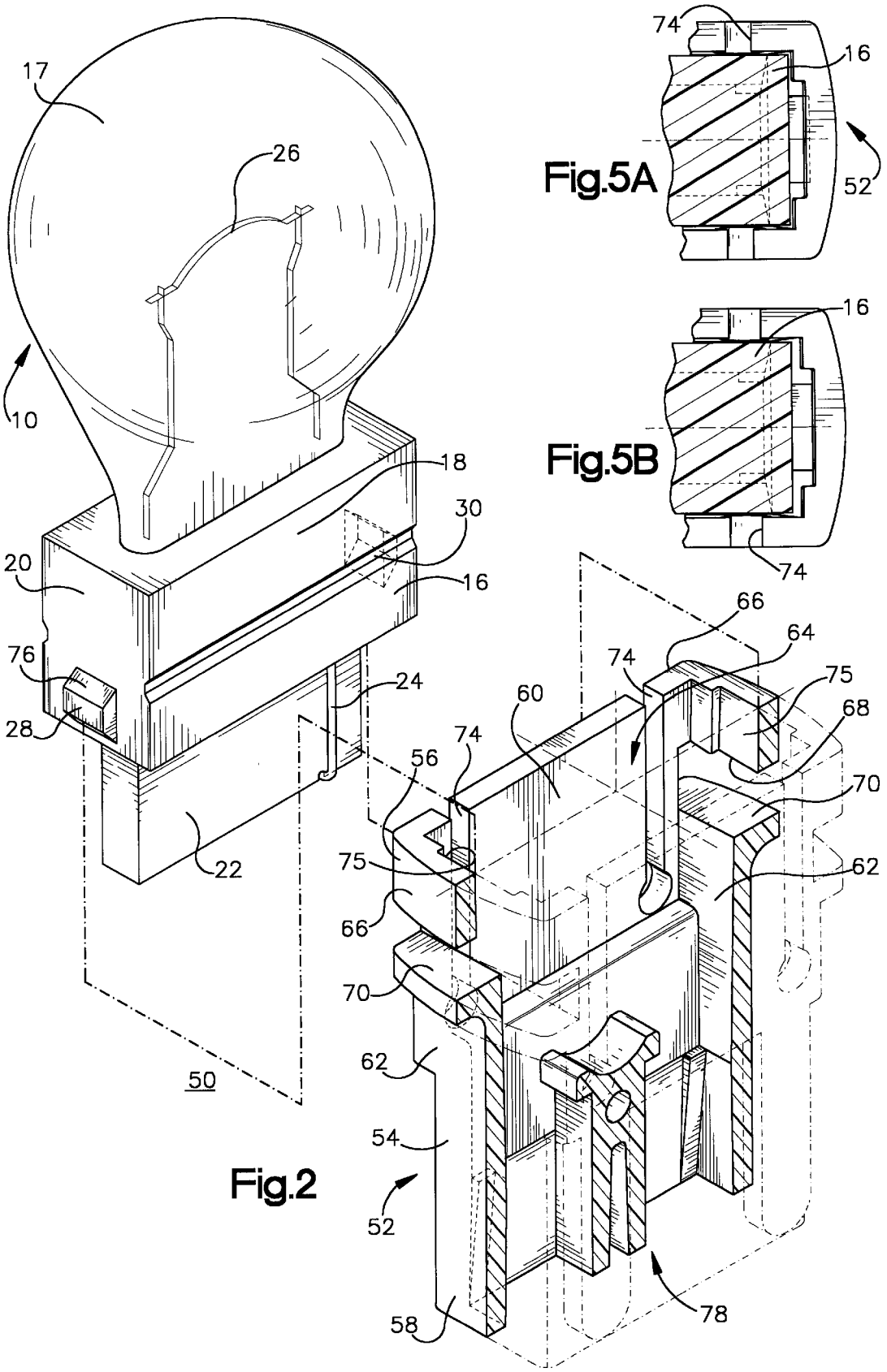
FIG. 2 is a perspective view in partial section of a landscape bulb and socket assembly constructed according to the present invention.
FIGS. 5A and 5B are views as each seen along a plane designated by lines 5—5 in FIG. 3, depicting deflection of an end wall of the socket.
Figure 3:
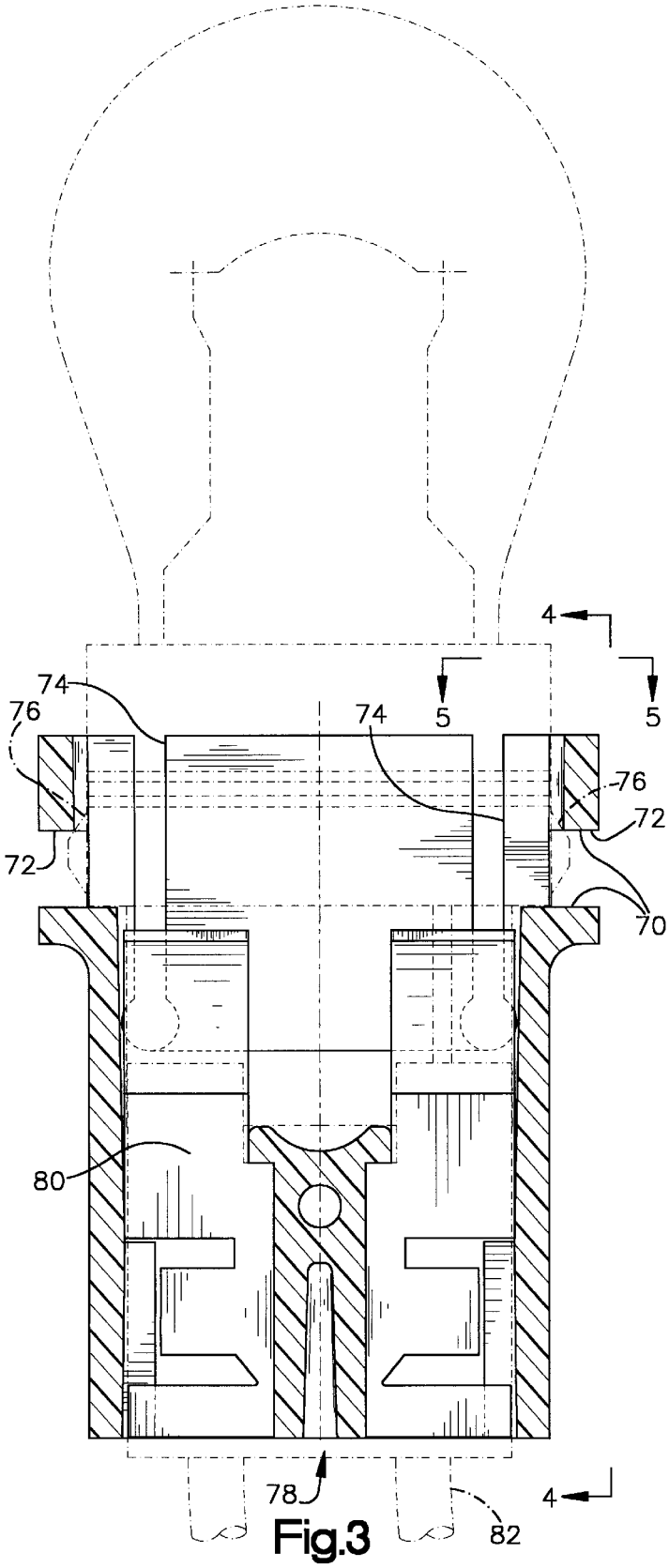
FIG. 3 is a vertical sectional view of a socket constructed according to the present invention.
Figure 4:
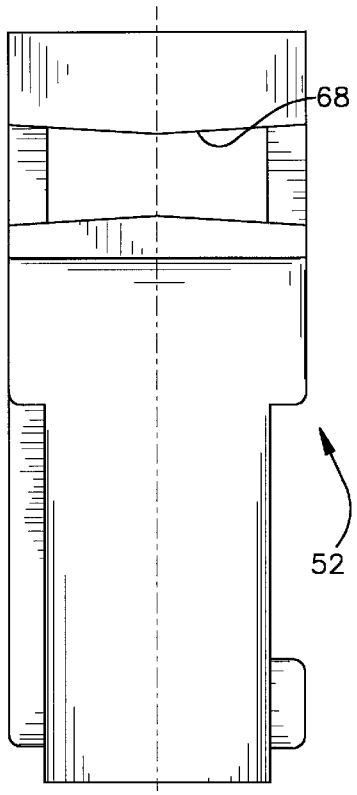
FIG. 4 is a side elevational view of the socket of FIG. 3.

Referring to the drawings and to FIG. 2 in particular, a landscape bulb and socket assembly constructed according to the invention is shown generally at 50. The assembly 50 includes the lamp 10 as well as a socket 52 of the present invention. An important feature of the invention is that the socket 52 has a body 54 integrally formed as one piece. The body 54 is preferably comprised of elastomeric material and has a first end portion 56 and a second end portion 58 spaced from the first end portion. The body 54 has two side walls 60 and two end walls 62 that extend between the side walls. The side and end walls 60, 62 cooperate to define a hollow interior 64. A movable ear 66 includes one of the end walls 62 and preferably has an opening 68 formed through it (FIG. 4). Each of the openings 68 is preferably generally rectangular and is adapted to receive one of the protrusions 28 of the lamp 10. Each opening 68 is defined by internal edges 70 of the body. An upper internal edge 70 forms an abutment surface 72 (FIG. 3) that is adapted to be engaged by a protrusion 28 to resist removal of the lamp 10 from the socket 52.

Slitted openings 74 are preferably formed in the side walls 60 and extend from the first end portion 56 toward the second end portion 58. The slits 74 separate the ears 66 from the remainder of the body 54, which permits the ears to be outwardly movable with respect to the remainder of the body 54. By forming the slits 74 in the side walls 60, the ears include a portion of the side walls. Each opening 68 is formed through an ear 66. As shown in FIG. 2, each of the ears 66 may include a groove 75 that extends from the first end portion 56 to the opening 68 for receiving one of the protrusions 28.

The socket 52 of the present invention is adapted to receive the conventional lamp 10. However, the groove 30 of the lamp base 16 is not necessary or utilized in the present invention. The openings 68 are preferably configured to be of a size sufficient to receive the protrusions 28 from both the single filament lamp 10 and the smaller protrusions from double filament lamps (not shown). In some applications the grooves 75 may be made narrower to exclude the use of single filament bulbs.

The abutment surfaces 72 (FIG. 3) resist movement of the protrusions 28 when a force is exerted to remove the lamp 10 from the socket 52. Thus, the abutment surfaces 72 prevent the lamp from being inadvertently removed from the socket 52. However, because the ears 66 are outwardly movable, if the removal force is greater than an inwardly directed return force attributable to the elasticity of the ears 66, the protrusions 28 move the ears 66 outwardly. The upper surface 76 of each protrusion 28 may be tapered as shown in FIGS. 2 and 3, which facilitates removing the protrusions 28 from the openings 68. As shown in FIG. 3, when a removal force is exerted while the protrusions 28 are within the openings 68, the abutment surfaces 72 move outwardly toward the end of the tapered protrusion surfaces 76.

As best shown in FIGS. 2 and 3, the interior of the socket 52 at the second end portion 58 includes structure 78 for mounting electrical contacts 80. Electrical wires 82 are connected to the contacts 80 in a manner known to those skilled in the art. Although the particular structure 78 and the electrical contacts 80 shown are preferable, it will be appreciated by those skilled in the art that the socket of the present invention may include other electrical contacts and structures for mounting them.

The lamp 10 is fastened to the socket 52 by first inserting a leading portion of the lamp 10 into the hollow interior 64 of the socket. As the lamp 10 is moved into the socket 52, the protrusions 28 are engaged in the grooves in the ears 66 and deflect the ears outwardly. The protrusions 28 move further into the socket 52 along the ears 66 until they enter the openings 68. At this point the lamp 10 is fastened to the socket 52. The protrusions 28 are positioned to be able to contact one of the abutment surfaces 72, which resists withdrawal of the lamp 10 from the socket 52.

As shown in FIG. 5A, when the protrusions 28 are located in the openings 68, the slits 74 have their normal widths since the ears 66 are not deflected by the protrusions 28. However, when a force is exerted to remove the lamp 10 from the socket 52, the protrusions 28 engage the abutment surfaces 72, which inhibits the protrusions 28 from being removed from the openings 68. Once a sufficient pulling force is exerted to overcome the inwardly directed force of elasticity of the ears 66, the protrusions 28 deflect the ears 66 outwardly. The protrusions 28 are pulled beyond the abutment surfaces 72 into contact with the grooves 75 in the interior surfaces of the ears 66. This maintains the outward deflection of the ears 66 and, as shown in FIG. 5B, widens the slits 74 beyond their normal widths. The lamp 10 may now be easily removed from the socket 52. After the lamp has been removed, the force of elasticity of the ears 66 causes the ears to move inwardly back to their original position and the slits to assume their normal size.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

What is claimed is:

1. A landscape lighting fixture comprising:

a rectangular lamp base for receiving a light bulb, said lamp base having a protrusion extending from at least one end portion thereof;

a socket that receives said lamp base, said socket comprising a body having two side walls and two end walls that have a shorter length than said side walls, wherein said side walls and said end walls cooperate to form a hollow rectangular interior of the socket;

an opening constructed and arranged completely through at least one of said end walls for receiving said protrusion, wherein an edge of said end wall defines a portion of said opening and resists removal of said protrusion from said socket; and slits formed through at least one of the walls of said socket flanking a region of said end wall that includes said opening for enabling said region to be outwardly flexed relative to an adjacent portion of the body of said socket upon engagement of said region with said protrusion.

2. The landscape lighting fixture of claim 1 wherein a portion of said lamp base extends from said socket when said lamp base is fully inserted in said socket, and none of said lamp portion has a perimeter larger than a perimeter of the hollow rectangular interior of said socket.

3. The landscape lighting fixture of claim 1 wherein slits are formed through at least one of the walls of said socket flanking a second region of said other end wall that includes a second said opening for enabling said second region to be outwardly flexed relative to an adjacent portion of the body of said socket upon engagement of said second region with another said protrusion, and a second edge of said other end wall defines a portion of said second opening and resists removal of said other protrusion from said socket.

4. The socket of claim 1 wherein said body is integrally formed as one piece.

5. The socket of claim 1 wherein said body is comprised of elastomeric material.

6. The socket of claim 1 wherein each of said openings has a generally rectangular shape.

7. The socket of claim 1 comprising an electrical contact assembly mounted in the interior of said socket.

8. The socket of claim 1 wherein at least one of said end walls comprises a groove on its interior surface for receiving one said protrusion.

9. A landscape lighting socket for receiving a lamp base of the type having a rectangular shape with a protrusion extending from at least one end portion thereof, said socket comprising:

a body having two side walls and two end walls that have a shorter length than said side walls, wherein said side walls and said end walls cooperate to form a hollow rectangular interior of the socket;

an opening constructed and arranged completely through at least one of said end walls for receiving said protrusion, wherein an edge of said end wall defines a portion of said opening and resists removal of said protrusion from said socket; and slits formed through at least one of the walls of said socket flanking a region of said end wall that includes said opening for enabling said region to be outwardly flexed relative to an adjacent portion of the body of said socket upon engagement of said region with said protrusion.

10. The landscape lighting socket of claim 9 wherein slits are formed through at least one of the walls of said socket flanking a second region of the other said end wall that includes a second said opening for enabling said second region to be outwardly flexed relative to an adjacent portion of the body of said socket upon engagement of said second region with another said protrusion, and a second edge of said other end wall defines a portion of said second opening and resists removal of said other protrusion from said socket.

11. The landscape lighting socket of claim 9 wherein said body is integrally formed as one piece.

12. The landscape lighting socket of claim 9 wherein said body is comprised of elastomeric material.

13. The landscape lighting socket of claim 9 wherein each said opening has a generally rectangular shape.

14. The landscape lighting socket of claim 9 comprising an electrical contact assembly mounted in the interior of said socket.

15. The landscape lighting socket of claim 9 wherein at least one of said end walls comprises a groove on its interior surface for receiving one said protrusion.

16. A method of fastening a lamp in an electrical socket of a landscape lighting fixture, comprising the steps of inserting a portion of a base of the lamp into a hollow rectangular interior of the socket formed by side walls and end walls of the socket, said end walls having a shorter length than said side walls, engaging a protrusion formed on at least one end portion of the lamp base with one of said end walls of said socket, deflecting a region of said one end wall outwardly relative to an adjacent portion of the socket by contact with said protrusion, said region being disposed on at least one of said end walls and each said region being flanked by slits formed through at least one of said walls of said socket, positioning each said protrusion in an opening located in said region and formed completely through at least one of said end walls, and resisting removal of each said protrusion from the socket with an edge of said end wall that defines a portion of said opening.

17. The method of claim 16 comprising guiding each said protrusion in a groove formed on an interior surface of at least one of said end walls.

18. The method of claim 16 comprising removing said lamp from said socket by pulling by hand a portion of said lamp base that extends from said socket when said lamp is fully inserted in said socket, wherein none of said lamp portion has a perimeter larger than a perimeter of the hollow rectangular interior of the socket.

19. The method of claim 16 wherein said lamp is unfastened from said socket by engaging said protrusion with said edge and exerting a pulling force on said lamp to deflect each said region outwardly.

* * * * *